US008789315B2

(12) United States Patent
Han et al.

(10) Patent No.: US 8,789,315 B2
(45) Date of Patent: Jul. 29, 2014

(54) ISOLATED REFUGE CABIN

(71) Applicant: The General Hospital of Shenyang Military Region of the Chinese People's Liberation Army, Shenyang (CN)

(72) Inventors: Yaling Han, Shenyang (CN); Jingyang Sun, Shenyang (CN); Tianming Yao, Shenyang (CN); Ming Liang, Shenyang (CN); Liancheng Zhang, Shanghai (CN)

(73) Assignee: The General Hospital of Shenyang Military Region of the Chinese People's Liberation Army, Shenyang, Liaoning (CN)

( * ) Notice: Subject to any disclaimer, the term of this patent is extended or adjusted under 35 U.S.C. 154(b) by 0 days.

(21) Appl. No.: 14/087,613

(22) Filed: Nov. 22, 2013

(65) Prior Publication Data

US 2014/0076324 A1 Mar. 20, 2014

Related U.S. Application Data

(63) Continuation of application No. 12/999,627, filed on Jan. 21, 2011, now abandoned.

(51) Int. Cl.

| | |
|---|---|
| ***E04B 1/34*** | (2006.01) |
| ***E04G 11/04*** | (2006.01) |
| ***E04H 15/20*** | (2006.01) |

(52) U.S. Cl.

USPC ..... 52/2.17; 52/2.18; 52/2.13; 52/2.24; 52/167.1

(58) Field of Classification Search

USPC ..... 52/2.11, 2.13, 2.17, 2.18, 2.24, 167.1, 52/169.9; 252/186.1

See application file for complete search history.

(56) References Cited

U.S. PATENT DOCUMENTS

| | | | | | |
|---|---|---|---|---|---|
| 2,910,994 | A * | 11/1959 | Joy | 52/2.11 |
| 4,409,978 | A * | 10/1983 | Bartos | 128/205.12 |
| 5,247,768 | A * | 9/1993 | Russo | 52/2.13 |
| 5,331,991 | A * | 7/1994 | Nilsson | 135/93 |
| 5,570,544 | A * | 11/1996 | Hale et al. | 52/2.18 |
| 8,079,182 | B1 * | 12/2011 | Higgins | 52/2.11 |
| 8,142,726 | B2 * | 3/2012 | Zharkov et al. | 422/126 |
| 2002/0023390 | A1 * | 2/2002 | Nagle | 52/2.18 |

(Continued)

*Primary Examiner* — Brian Glessner
*Assistant Examiner* — Brian D Mattei
(74) *Attorney, Agent, or Firm* — Houtteman Law LLC

(57) ABSTRACT

The present invention relates a refuge used in underground mines, and more particularly to a type of isolated refuge cabin used in underground mines, including the supporting airbag (1), the body shell (2) equipped outside the supporting air bag (1), a breathable air supplier (4) and an air inflation device (3); the air outlet (5) of the air inflation device (3) is linked with an air outlet (7) of the supporting air bag (1) through an air supply passage (6); the air inlet (8) of the breathable air supplier (4) is connected to the interior cavity of the body shell (2) through an air intake passage (9); the air outlet (10) of the breathable air supplier (4) is linked with the lower part of the interior cavity of the body shell (2) through the air outlet passage (11); the breathable air supplier (4) includes a shell (12), the oxygen generating agent (13) equipped inside the shell (12); the emergency exit (14) is installed on the body shell (2). The present invention provides an isolated refuge cabin of a simple structure, which can be operated safely and easily to effectively separate the exterior environment of the mining accident areas and provide conditions for survival for human beings involved in the mine accidents.

8 Claims, 3 Drawing Sheets

(56) References Cited

U.S. PATENT DOCUMENTS

2002/0083653 A1* 7/2002 Hilbert ..... 52/2.17
2007/0202796 A1* 8/2007 Kennedy et al. ..... 454/230
2008/0120919 A1* 5/2008 VanBasten et al. ..... 52/2.17

* cited by examiner

ISOLATED REFUGE CABIN

FIELD OF THE INVENTION

The present invention relates to a refuge used in underground mines, and more particularly to a type of isolated refuge cabin used in underground mines.

BACKGROUND TECHNOLOGY

At present, there has been no existing rescue equipment that can be used to accommodate a large group of people and provide oxygen for over 72 hours in underground mines in China. When an accident occurs in an underground mine, a large amount of the toxic gas is usually generated. The composition of the gas which has toxic effects on humans basically falls into 3 types:

1. Compositions causing asphyxiation or coma;
2. Compositions causing irritation to sensory organs or respiratory system;
3. Other toxic compositions.

From the death toll statistic information of mine accidents, most of the victims died of inhalation of toxic gas such as carbon monoxide. Due to the block-up or submergence of the mining tunnels, the miners could not flee through the mining passageways and the possibility of their survival is minimal. This is one of the major reasons that there have been so many deaths in mining accidents in China.

SUMMARY OF THE INVENTION

One of the objectives of the present invention is to provide an isolated-refuge cabin of a simple structure, which can be operated safely and easily to effectively separate the exterior environment of the mining accident areas and provide conditions for survival for human beings involved in the mine accidents.

Example embodiments of the present invention provide an isolated refuge cabin including a supporting air bag, a body shell equipped outside of the supporting air bag, a breathable air supplier and an air inflation device. The air outlet of the air inflation device is linked with the air inlet of the supporting air bag through an air supply passage. The air inlet of the breathable air supplier is connected to the interior cavity of the body shell through an air intake passage. The air outlet of the breathable air supplier is linked to the lower part of the interior cavity of the body shell through an air outlet passage. The breathable air supplier includes a shell and oxygen generating agent equipped between the air inlet and the air outlet. An emergency exit is installed on the body shell.

In a preferred example embodiment of the present invention, the oxygen generating agent is of a flaky structure. Installation racks are installed in the shell. The installation grids are installed on the installation racks. The oxygen generating agent is stored between the installation grids.

Heat dissipation fins are installed outside the breathable air supplier.

The supporting air bag has a relief valve and a one-way intake valve is installed at the air inlet In order to obtain the pressure balance between the body shell and the exterior environment, an adjuster is installed in the body shell and contains the toxic gas filtering agent. The exterior end and the body shell end of the adjuster are connected respectively to the toxic gas filtering agent. The body shell end of the adjuster is connected to the interior cavity of the body shell.

In order to form an air circulation, a blowing mechanism is installed at the joint of the air outlet and the lower part of the interior cavity of the body shell.

The blowing mechanism includes a blower body shell, a spring drive mechanism installed in the blower body shell, and a power output shaft mounted with a power output gear. A transmission gear and a drive spring are mounted on the centre shaft of the spring drive mechanism. The drive spring is installed in an assembly housing. A drive gear and a power transmission gear are engaged. The power output shaft is installed in the blower body shell and the blower blades are mounted at the top end of the power output shaft.

In an example embodiment of the present invention, a transitional shaft is installed in the blower body shell. A transitional gear and a power transmission gear are mounted on the transitional shaft. The power transmission gear is engaged with the transitional gear. The power transitional transmission gear is engaged with the power output gear.

In order to control the blowing force of the blowing mechanism, a speed controlling shaft is installed in the blower body shell. A speed controlling drive gear is mounted on the speed controlling shaft. A speed controlling transmission gear is engaged with the power output gear and also engaged with the speed control drive gear. A speed controlling mechanism is mounted on the speed controlling shaft. The speed controlling mechanism includes a speed controlling sheath, which is installed in the blower body shell, and a speed controlling chuck, which is mounted on the speed controlling shaft. A concave groove is formed on the speed controlling chuck. A speed controlling terminal is installed in the concave groove. The speed controlling chuck and the speed controlling terminal are both installed in the speed controlling sheath.

The body shell of the present invention includes an aluminum foil layer, a fire-proof fabric layer, a rubber layer, and a fabric layer. The fire-proof fabric layer is disposed between the aluminum foil layer and the rubber layer, and the rubber layer is disposed between the fire-proof fabric layer and the fabric layer.

Example embodiments of the present invention provide an isolated refuge cabin of a simple structure, which can be operated safely and easily to effectively separate the exterior environment of the mining accident areas and provide conditions for survival for human beings involved in the mine accidents. In emergent circumstance, the air inflation device can be turned on immediately and the supporting air bag will prop up the body shell. The whole system will enter working status immediately. In example embodiments of the present invention, the conversion between carbon dioxide and oxygen can be realized so as to provide conditions for survival for human beings involved in the mine accidents. In order to control the blowing force of the blowing mechanism, a speed control mechanism is installed in the blowing mechanism. In the speed control mechanism, a speed controlling terminal generates torque to the power output shaft based on the rotation speed of the power output shaft based by using the friction between the speed controlling terminal and the speeding controlling sheath. Thus, the blowing force of the blowing mechanism can be effectively controlled.

DETAILED DESCRIPTION OF THE PREFERRED EMBODIMENT

Figure 1:
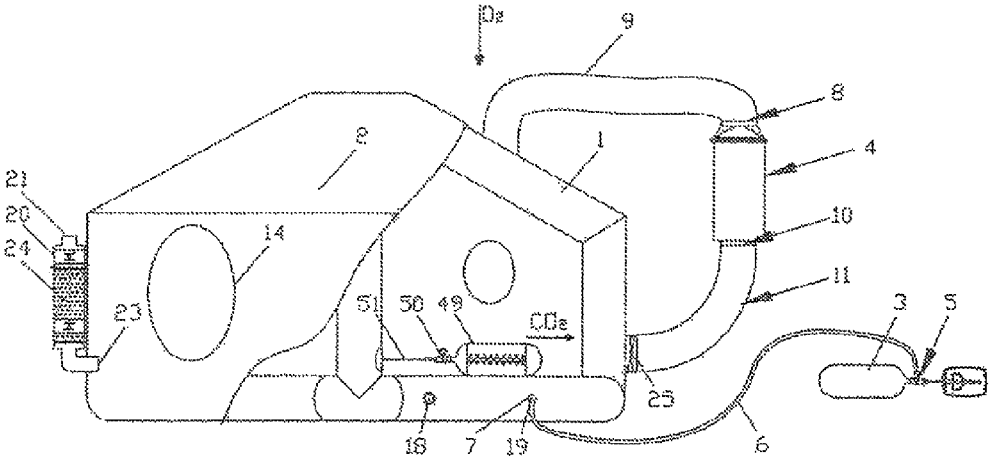
FIG. 1 is a perspective exploded view according to an example embodiment of the present invention.
Figure 2:
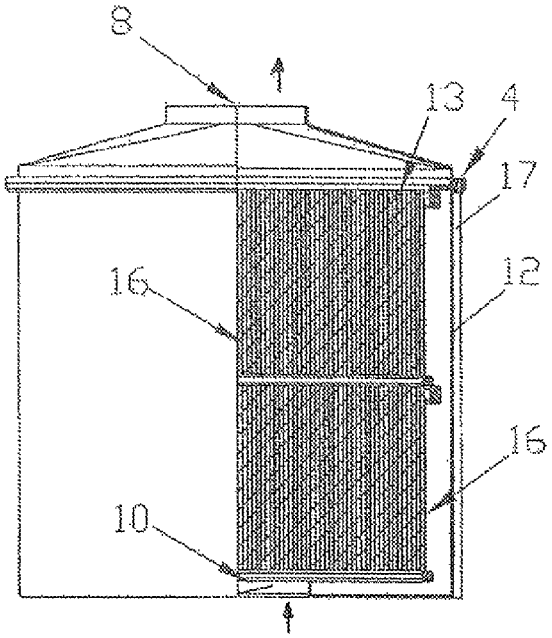
FIG. 2 is a cross-sectional view of the breathable air supplier according to an example embodiment of the present invention.
Figure 4:
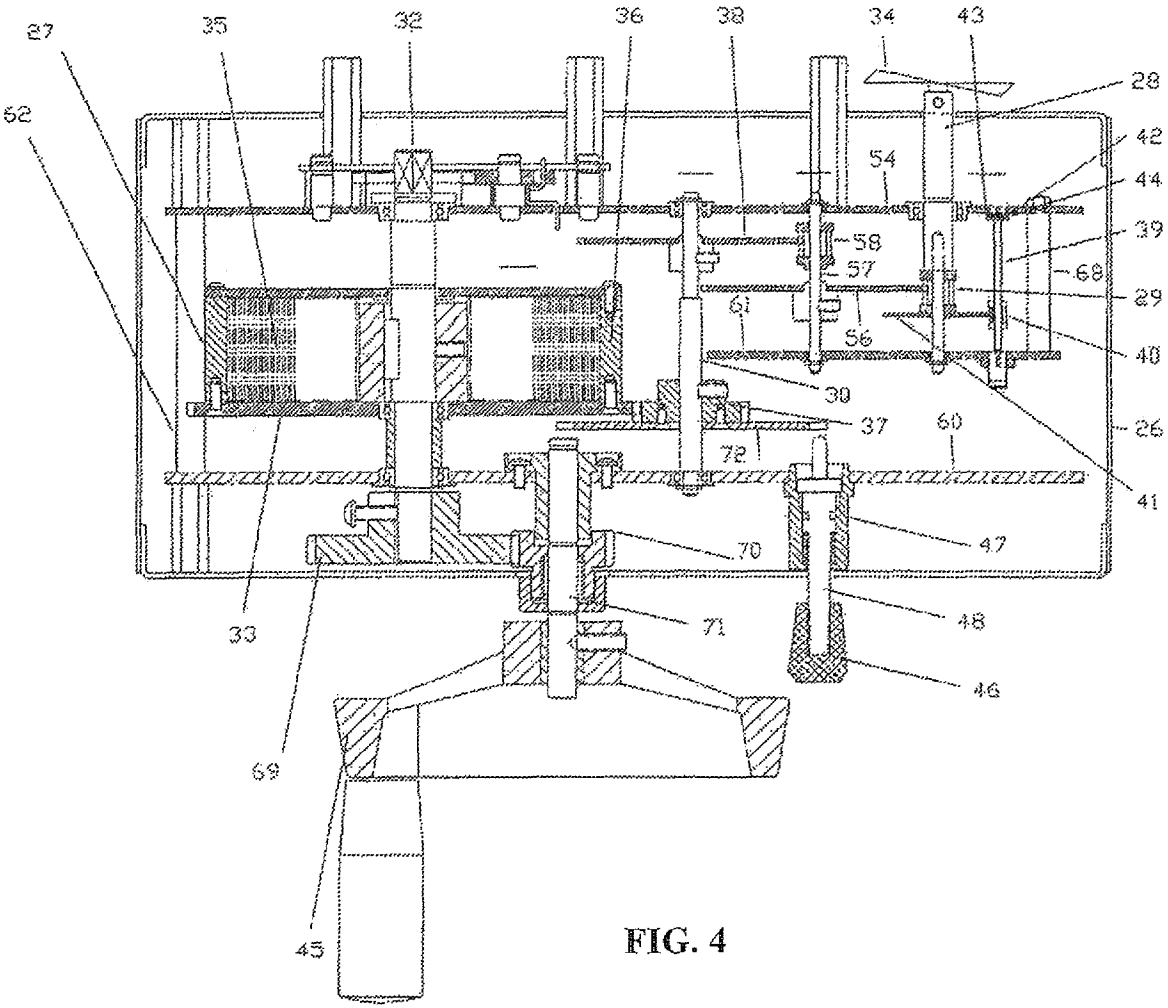
FIG. 4 is a cross-sectional view of the blowing mechanism according to an example embodiment of the present invention.
Figure 3:
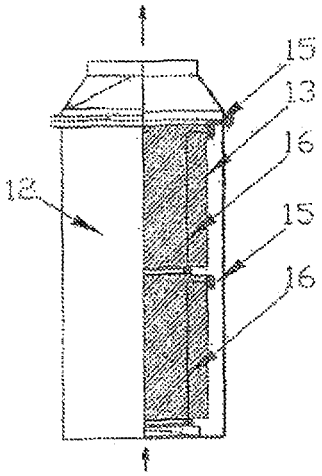
FIG. 3 is another cross-sectional view of the breathable air supplier according to an example embodiment of the present invention.
Figure 5:
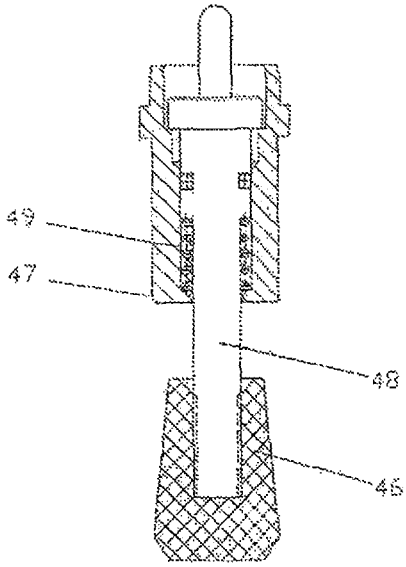
FIG. 5 is a cross-sectional view of the stop valve according to an example embodiment of the present invention.
Figure 6:
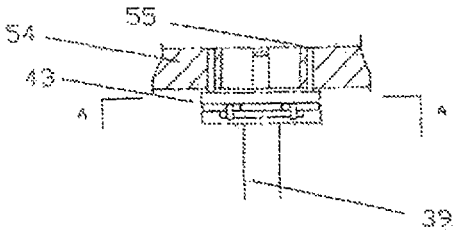
FIG. 6 is a partial cross-sectional view of the speed controlling mechanism according to an example embodiment of the present invention.
Figure 7:
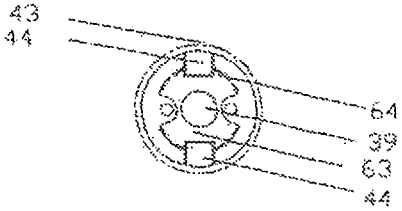
FIG. 7 is a top view of the speed controlling mechanism along A-A Direction according to FIG. 6.
Figure 8:
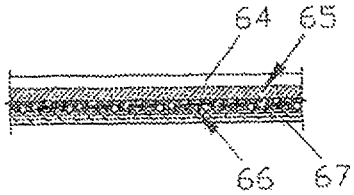
FIG. 8 is a partial cross-sectional view of the body shell according to an example embodiment of the present invention.

As shown in FIGS. 1, 2 and 3, an isolated-refuge cabin includes a supporting air bag 1, a body shell 2 equipped outside the supporting air bag 1, a breathable air supplier 4 and an air inflation device 3. The air outlet 5 of the air inflation device 3 is connected to an air inlet 7 of the supporting air bag 1 through an air supply passage 6. The air inlet 8 of the breathable air supplier 4 is connected to the interior cavity of the body shell 2 through an air intake passage 9. The air outlet 10 of the breathable air supplier 4 is linked to the lower part of the interior cavity of the body shell 2 through the air outlet passage 11. The breathable air supplier 4 includes a shell 12 and an oxygen generating agent 13 equipped between the air inlet 8 and the air outlet 10. An emergency exit 14 is installed on the body shell 2. The oxygen generating agent 13 is of a flaky structure. Installation racks 15 are installed inside the shell 12. Installation grids 16 are installed on the installation racks 15. The oxygen generating agent 13 is stored between the installation grids 16. Heat dissipation fins 17 are installed outside the breathable air supplier 4. The supporting air bag 1 has a relief valve 18 and a one-way air intake valve 19 is installed at the air inlet 7. An adjuster 20 is installed on the outside of the body shell 2. The adjuster 20 contains toxic gas filtering agent 24 and has an exterior end 21 and a body shell end 23. Both the exterior end 21 and the body shell end 23 are connected to the toxic gas filtering agent 24. The toxic gas filtering agent 24 may be hopcalite catalyst, which consists of manganese dioxide and cupric oxide, and turns the toxic carbon monoxide in the air into the non-toxic carbon dioxide under normal temperature. The body shell end 23 is connected to the interior cavity of the body shell 2. A blowing mechanism 25 is installed at the joint of the air outlet 11 and the lower part of the interior cavity of the body shell 2. As shown in FIG. 4, the blowing mechanism 25 includes a blower body shell 26, a spring drive mechanism 27 installed in the blower body shell 26, and a power output shaft 28 mounted with a power output gear 29. A transmission gear 33 and a drive spring 35 are mounted on the centre shaft 32 of the spring drive mechanism 27. The drive spring 35 is installed in an assembly housing 36. The transmission gear 33 is engaged with the power output gear 29. The power output shaft 28 is installed in the blower body shell 26 with blower blades 34 mounted at the top end. A transitional transmission shaft 30 is installed in the blower body shell 26. A drive gear 37 and a power transmission gear 38 are mounted on the transitional transmission shaft 30. The transmission gear 33 is engaged with the drive gear 37 and the power transmission gear 38 is engaged with the power output gear 29. As shown in FIGS. 4, 6 and 7, for controlling the blowing force of the blowing mechanism 25, in an example embodiment of the invention, a speed controlling shaft 39 is installed in the blower body shell 26. A speed controlling drive gear 40 is mounted on the speed controlling shaft 39. The speed controlling transmission gear 41 is engaged with the power output gear 29 and also engaged with the speed controlling drive gear 40. A speed controlling mechanism 42 is mounted on the speed controlling shaft 39. The speed controlling mechanism 42 includes a speed controlling sheath 43, which is installed in the blower body shell 26, and a speed controlling chuck 63, which is mounted on the speed controlling shaft 39. A concave groove 64 is formed on the speed controlling chuck 63. The speed controlling terminal 44 is installed in the concave groove 64. The speed controlling chuck 63 and the speed controlling terminal 44 are both installed in the speed controlling sheath 43. In an example embodiment of the present invention, a transitional shaft 57 is installed between the transitional transmission shaft 30 and the power output shaft 28. The transitional shaft 57 is mounted on the blower body shell 26. A transitional gear 58 and a power transitional transmission gear 56 are mounted on the transitional shaft 57. The power transmission gear 38 is engaged with the transitional gear 58. The power transitional transmission gear 56 is engaged with the power output gear 29. As shown in FIG. 4, installation racks 54, 61 and 60 are mounted on the blower body shell 26 integrally. The centre shaft 32, the transitional shaft 57, the power output shaft 28 and the speed controlling shaft 39 are respectively mounted on the installation racks 54, 61 and 60 through shaft sleeves. A screw 62 is used to fix the installation racks 54 and 60. A screw 68 is used to fix the installation racks 54 and 61. A drive handle 45 is used to drive the spring drive mechanism 27. When it is needed to supply power to the spring drive mechanism 27, the drive handle 45 is rotated and power is transmitted to the driven gear 69 mounted on the centre shaft 32 through a gear 70 mounted on the drive shaft 71. As shown in FIGS. 4 and 5, in an example embodiment of the present invention, a stop valve may be installed on the blower body shell 26. The stop valve includes a control rod cap 46 installed on a control rod 48 and a return spring assembly box 47 mounted on the installation rack 60. The control rod 48 is installed inside the return spring assembly box 47. The return spring 49 is installed on the control rod 48. When brake is needed, the control rod cap 46 is pressed and the working terminal on top of the control rod 48 will touch on the stop gear 72 under the drive gear 37 and thus stops the drive mechanism. When it is need to run the drive mechanism, the control rod cap 46 is released, and the control rod 48 will return to its original position under the action of the return spring 49 and the drive mechanism will continue to work.

The body shell 2 of the present invention includes an aluminum foil layer 64, a fire-proof fabric layer 65, a rubber layer 66 and a fabric layer 67. The fire-proof fabric layer 65 is disposed between the aluminum foil layer 64 and the rubber layer 66, and the rubber layer 66 is disposed between the fire-proof fabric layer 65 and the fabric layer 67.

Under normal conditions, all components in the present invention will be integrated in a package. In emergent circumstances, the air inflating device 3 can be turned on immediately, and the supporting sir bag 1 is then inflated and props up the body shell 2. Thus, the whole system will enter working status immediately. As shown in FIG. 1, after the body shell 2 is propped up, a cavity is formed and miners underground can enter into the cavity through the emergency exit 14. As shown in FIGS. 1, 2 and 3, after the miners underground enter the body shell 2, emergency exit 14 can be closed and the breathable air supplier 4 will supply breathable air to the miners.

The breathable air supplier 4 is a module designed in such a way that the oxygen generating agent 13 can be stored between the installation grids 16 when needed. Thus, the oxygen generating agent 13 can be fixed on the installation racks 15 through the installation grids 16. The number of the installation racks 15 is variable according to actual needs. The emergency exit 14 is provided on the body shell 2. In a preferred example embodiment of the invention, the oxygen generating agent 13 may be sodium dioxide. As shown in FIG. 2, in order to reduce the working temperature of the breathable air supplier 4, the heat dissipation fins 17 are installed outside the breathable air supplier 4. In order to adjust the internal pressure of the supporting air bag 1, as shown in FIG. 1, a relief valve 18 is installed on the supporting air bag 1. When the internal pressure of the supporting air bag 1 exceeds a certain level, the relief valve 18 will open and the working pressure within the supporting sir bag 1 can be adjusted to the desired level. In order to improve the working efficiency of the air inflating device 3, the one-way air intake valve 19 is installed at the air inlet 7. In order to obtain the pressure balance between the body shell 2 and the exterior environment, the adjuster 20 is installed in the body shell 2 and contains the toxic gas filtering agent 24. The exterior end 21 and the body shell end 23 of the adjuster 20 are connected respectively to the toxic gas filtering agent 24. The body shell end 23 of the adjuster 20 is connected to the interior cavity of the body shell 2, and thus the pressure between the interior cavity of the body shell 2 and the exterior environment can be adjusted by means of the adjuster 20. In another example embodiment of the present invention, an air inflating bottle 49 may be installed inside the wall body 2. The inflating bottle 49 has a fast release valve 50 that has a wire 51. One end of the wire 51 is fixed on the supporting air bag 1. When the body shell 2 is propped up, the wire 51 is stretched and opens the air inflating bottle 49. Thus, the pressure balance between the interior and exterior of the body shell 2 can be achieved.

While in operation, the air inflation device 3 can be turned on quickly and the compressed air in the air inflation device 3 can be supplied to the supporting air bag 1 through the air supply passage 6 and the air inlet 7 of the supporting air bag 1. The supporting air bag 1 will immediately prop up the body shell 2 to form a safety tank and the whole system will enter into working status immediately. The miners underground will enter the body shell 2 through the emergency exit 14 and then close the emergency exit 14. The oxygen generated from the breathable air supplier 14 is supplied to the interior of the body shell 2 through the air inlet 8 and the air inlet passage 9. The carbon dioxide that the miners breathe out is blown into the breathable air supplier 4 through the air outlet passage 11 and the air outlet 10 by the blowing mechanism 25, and reacts with the oxygen generating agent 13 on the installation grids 16 to generate oxygen. The generated oxygen is supplied to the interior cavity of the body shell 2 through the air inlet 8, and a circulation is thus formed.

What is claimed is:

1. An isolated refuge cabin, comprising:

a supporting air bag (1);

a body shell (2) equipped outside the supporting air bag (1);

a breathable air supplier (4);

an air inflation device (3);

heat dissipation fins (17) installed outside the breathable air supplier (4), wherein the supporting air bag (1) has a relief valve (18) and a one-way air intake valve (19) is installed at the air inlet (7);

an adjuster (20) installed on the outside of the body shell (2), the adjuster (20) containing toxic gas filtering agent (24) and having an exterior end (21) and a body shell end (23), wherein both the exterior end (21) and the body shell end (23) are connected to the toxic gas filtering agent (24), and the body shell end (23) is connected to the interior cavity of the body shell (2); and a blowing mechanism (25) installed at the joint of the air outlet (11) and the lower part of the interior cavity of the body shell (2);

wherein an air outlet (5) of the air inflation device (3) is connected to an air inlet (7) of the supporting air bag (1), an air inlet (8) of the breathable air supplier (4) is connected to the interior cavity of the body shell (2) through an air intake passage (9), an air outlet (10) of the breathable air supplier (4) is linked to the lower part of the interior cavity of the body shell (2), the breathable air supplier (4) includes a shell (12) and an oxygen generating agent (13) equipped between the air inlet (8) and the air outlet (10), and an emergency exit (14) is installed on the body shell (2);

wherein the blowing mechanism (25) includes a blower body shell (26), a spring drive mechanism (27) installed in the blower body shell (26), and a power output shaft (28) mounted with a power output gear (29), a transmission gear (33) and a drive spring (35) mounted on a centre shaft (32) of the spring drive mechanism (27), wherein the drive spring is installed in an assembly housing (36), the transmission gear (33) is engaged with the power output gear (29), the power output shaft (28) is installed in the blower body shell (26) with blower blades (34) mounted at the top end of the power output shaft (28).

2. The isolated refuge cabin according to claim 1, further comprising a transitional transmission shaft (30) installed in the blower body shell (26), a driver gear (37) and a power transmission gear (38) mounted on the transitional transmission shaft (30), wherein the transmission gear (33) is engaged with the drive gear (37) and the power transmission gear (38) is engaged with the power output gear (29).

3. The isolated refuge cabin according to claim 2, further comprising a speed controlling shaft (39) installed in the blower body shell (26), a speed controlling drive gear (40) mounted on the speed controlling shaft (39), a speed controlling transmission gear (41) engaged with the power output gear (29) and also engaged with the speed controlling drive gear (40), and a speed controlling mechanism (42) mounted on the speed controlling shaft (39); wherein the speed controlling mechanism (42) includes a speed controlling sheath (43) installed in the blower body shell (26), a speed controlling chuck (63) mounted on the speed controlling shaft (39), a concave groove (64) formed on the speed controlling chuck (63), a speed controlling terminal (44) installed in the concave groove (64), wherein the speed controlling chuck (63) and the speed controlling terminal (44) are both installed in the speed controlling sheath (43).

4. The isolated refuge cabin according to claim 3, wherein the body shell (2) includes an aluminum foil layer (64), a fire-proof fabric layer (65), a rubber layer (66) and a fabric layer (67), wherein the fire-proof fabric layer (65) is disposed between the aluminum foil layer (64) and the rubber layer (66), and the rubber layer (66) is disposed between the fire-proof fabric layer (65) and the fabric layer (67).

5. An isolated refuge cabin, comprising:

a supporting air bag (1);

a body shell (2) equipped outside the supporting air bag (1);

a breathable air supplier (4);

an air inflation device (3);

heat dissipation fins (17) installed outside the breathable air supplier (4), wherein the supporting air bag (1) has a relief valve (18) and a one-way air intake valve (19) is installed at the air inlet (7);

an adjuster (20) installed on the outside of the body shell (2), the adjuster (20) containing toxic gas filtering agent (24) and having an exterior end (21) and a body shell end (23), wherein both the exterior end (21) and the body shell end (23) are connected to the toxic gas filtering agent (24), and the body shell end (23) is connected to the interior cavity of the body shell (2);

a blowing mechanism (25) installed at the joint of the air outlet (11) and the lower part of the interior cavity of the body shell (2); and installation racks (15) installed inside the shell (12), and installation grids (16) installed on the installation racks (15), and the oxygen generating agent (13) is stored between the installation grids (16), and wherein the oxygen generating agent (13) is of a flaky structure;

wherein an air outlet (5) of the air inflation device (3) is connected to an air inlet (7) of the supporting air bag (1), an air inlet (8) of the breathable air supplier (4) is connected to the interior cavity of the body shell (2) through an air intake passage (9), an air outlet (10) of the breathable air supplier (4) is linked to the lower part of the interior cavity of the body shell (2), the breathable air supplier (4) includes a shell (12) and an oxygen generating agent (13) equipped between the air inlet (8) and the air outlet (10), and an emergency exit (14) is installed on the body shell (2);

wherein the blowing mechanism (25) includes a blower body shell (26), a spring drive mechanism (27) installed in the blower body shell (26), and a power output shaft (28) mounted with a power output gear (29), a transmission gear (33) and a drive spring (35) mounted on a centre shaft (32) of the spring drive mechanism (27), wherein the drive spring is installed in an assembly housing (36), the transmission gear (33) is engaged with the power output gear (29), the power output shaft (28) is installed in the blower body shell (26) with blower blades (34) mounted at the top end of the power output shaft (28).

6. The isolated refuge cabin according to claim 5, further comprising a transitional transmission shaft (30) installed in the blower body shell (26), a driver gear (37) and a power transmission gear (38) mounted on the transitional transmission shaft (30), wherein the transmission gear (33) is engaged with the drive gear (37) and the power transmission gear (38) is engaged with the power output gear (29).

7. The isolated refuge cabin according to claim 6, further comprising a speed controlling shaft (39) installed in the blower body shell (26), a speed controlling drive gear (40) mounted on the speed controlling shaft (39), a speed controlling transmission gear (41) engaged with the power output gear (29) and also engaged with the speed controlling drive gear (40), and a speed controlling mechanism (42) mounted on the speed controlling shaft (39); wherein the speed controlling mechanism (42) includes a speed controlling sheath (43) installed in the blower body shell (26), a speed controlling chuck (63) mounted on the speed controlling shaft (39), a concave groove (64) formed on the speed controlling chuck (63), a speed controlling terminal (44) installed in the concave groove (64), wherein the speed controlling chuck (63) and the speed controlling terminal (44) are both installed in the speed controlling sheath (43).

8. The isolated refuge cabin according to claim 7, wherein the body shell (2) includes an aluminum foil layer (64), a fire-proof fabric layer (65), a rubber layer (66) and a fabric layer (67), wherein the fire-proof fabric layer (65) is disposed between the aluminum foil layer (64) and the rubber layer (66), and the rubber layer (66) is disposed between the fire-proof fabric layer (65) and the fabric layer (67).

* * * * *